US006508744B1

(12) United States Patent
Carolus

(10) Patent No.: US 6,508,744 B1
(45) Date of Patent: Jan. 21, 2003

(54) CARDIOVASCULAR FITNESS EQUIPMENT IN FURNITURE

(75) Inventor: Jeffrey W. Carolus, Broadbrook, CT (US)

(73) Assignee: Home Fitness Furniture, Broadbrook, CT (US)

( * ) Notice: Subject to any disclaimer, the term of this patent is extended or adjusted under 35 U.S.C. 154(b) by 0 days.

(21) Appl. No.: 09/718,616

(22) Filed: Nov. 22, 2000

Related U.S. Application Data

(60) Provisional application No. 60/167,117, filed on Nov. 23, 1999.

(51) Int. Cl.[7] ..... A63B 22/02
(52) U.S. Cl. ..... 482/54; 482/904; 482/148
(58) Field of Search ..... 482/54, 904, 148

(56) References Cited

U.S. PATENT DOCUMENTS 5,813,947 A * 9/1998 Densmore ..... 482/51
6,146,316 A * 11/2000 Carolus ..... 482/98

* cited by examiner

*Primary Examiner*—Michael A. Brown
*Assistant Examiner*—Lori Baker Amerson
(74) *Attorney, Agent, or Firm*—McCormick, Paulding & Huber LLP

(57) ABSTRACT

In a convertible cardiovascular exercise apparatus, a frame is provided having an interior area adapted to support the exercise apparatus. The frame includes a pair of arm rests coupled thereto and on opposite sides thereof. The cardiovascular exercise apparatus is moveable between an inactive position wherein the exercise apparatus can be stored within the interior area, and an active wherein the apparatus can be put to use by a user. When in the inactive position, the cardiovascular exercise apparatus can be concealed by using cushions, thereby converting the apparatus to an article of furniture adapted to support at least one person in a seated position.

6 Claims, 5 Drawing Sheets

CARDIOVASCULAR FITNESS EQUIPMENT IN FURNITURE

CROSS REFERENCE TO RELATED APPLICATIONS

This application claims priority under 35 U.S.C. §119(e) to U.S. Provisional Patent Application Ser. No. 60/167,117 filed Nov. 23, 1999, entitled CARDIOVASCULAR FITNESS EQUIPMENT IN FURNITURE of Jeffrey W. Carolus.

FIELD OF THE INVENTION

The present invention relates generally to exercise equipment, and is more specifically directed to equipment convertible from an exercising configuration to an article of furniture adapted to support at least one person in a seated position.

BACKGROUND OF THE INVENTION

For a variety of different reasons, such as time constraints, privacy, or convenience, people often prefer to exercise in their own homes. In an effort to address this situation, there has been in recent years a proliferation of various different types of exercising apparatus for home use. Most of this equipment is of the stand alone type and requires that a person either leave the equipment out in the open, or have an area in which the equipment can be stored when not in use. While some of these devices may collapse to a configuration requiring less storage space, nevertheless, a person must still allocate an accessible storage location for the equipment. In contrast, some types of equipment, such as, for example, sets of weights and the benches used in connection therewith do not lend themselves to relocation for storage, as the weights are inherently quite heavy and the benches tend to be very cumbersome.

The problem of finding a place to store the exercise equipment or alternatively allocating a location wherein the equipment can be permanently located is exacerbated by the fact that people often live in apartments or crowded homes where sufficient storage or free space is simply not available. Accordingly, people in these situations do not buy exercise equipment, or they are forced to go to a gymnasium or join a health club in order to be able to work out on exercise equipment. Often, due to the inconvenience associated with having to travel to and from the gym, these persons forgo exercising altogether which can pose significant health problems.

Based on the foregoing, it is the general object of the present invention to provide an exercising apparatus that overcomes the difficulties and drawbacks of prior art exercising equipment.

It is a more specific object of the present invention to provide an exercising apparatus for home use that, when not functioning as exercise equipment, is convertible to an article of furniture adapted to support at least one person in a seated position.

DETAILED DESCRIPTION

Figure 1:
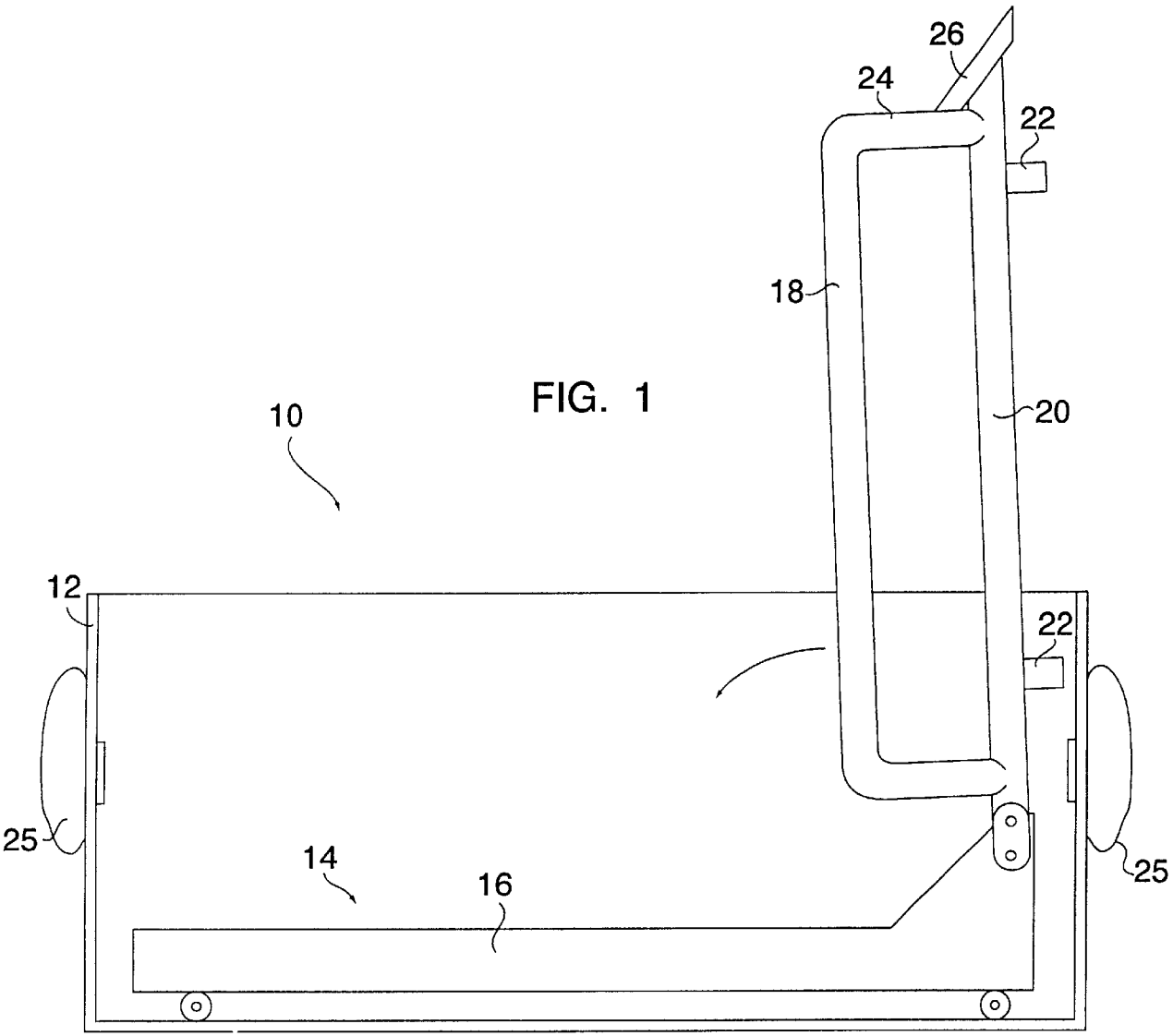
FIG. 1 is a partial side elevational view of an embodiment of the apparatus of the present invention showing a combination sofa/treadmill with the treadmill being movable between an active position (shown), and an inactive position.
Figure 2:
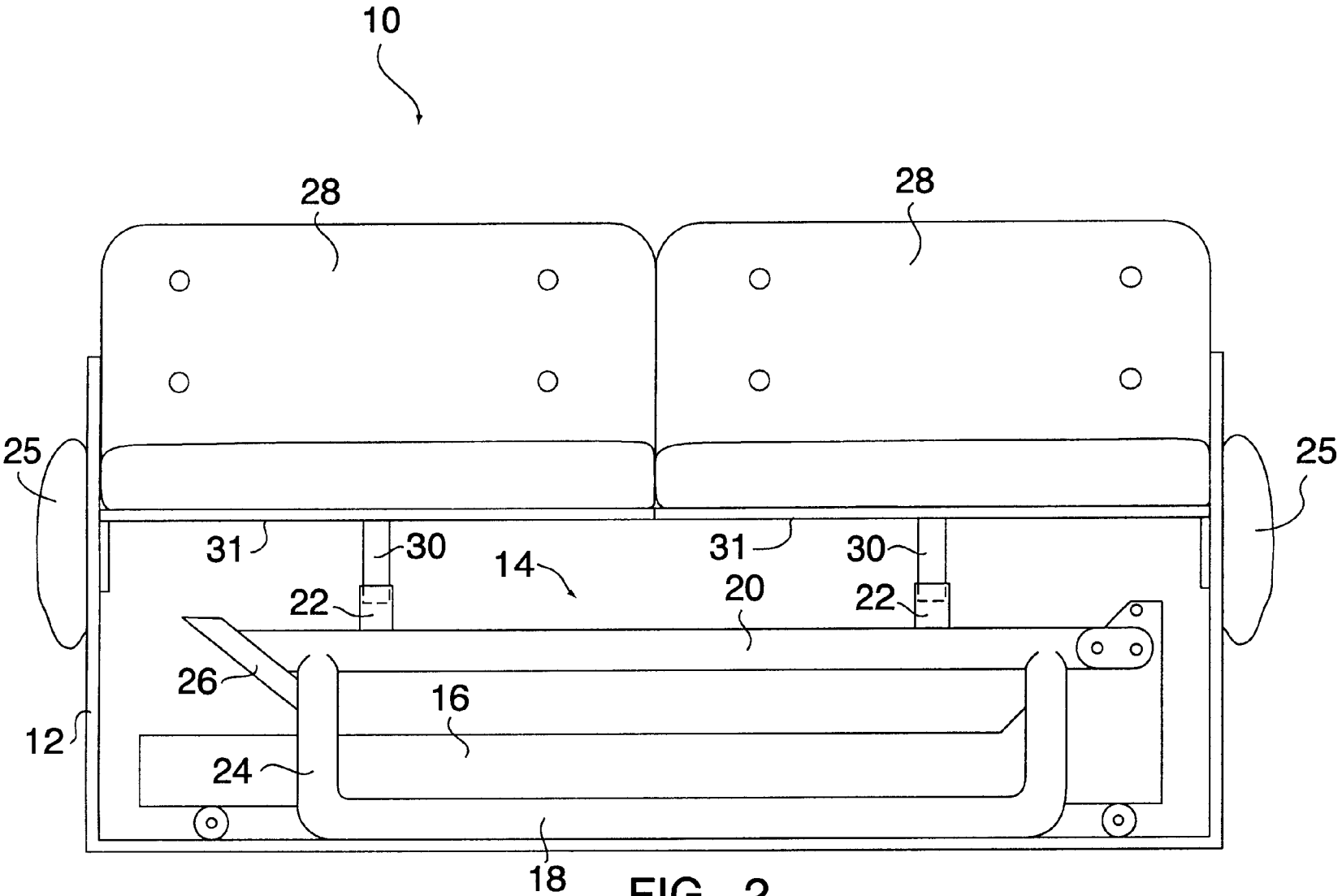
FIG. 2 is a partial side elevational view of the apparatus of FIG. 1, shown in the inactive position.

As shown in FIG. 1, an embodiment of the apparatus of the present invention generally designated by the reference numeral 10 includes a frame 12 having a treadmill generally designated by the reference numeral 14 supported thereon. The treadmill includes a base section 16 and a handle portion 18 coupled to the base section and movable between an active position (shown in FIG. 1) and an inactive position (FIG. 2). The handle portion 18 defines a support member 20 having a pair of brackets 22 extending outwardly therefrom. An upper member 24 defined by the handle portion includes a control panel 26 extending therefrom and from which a user can operate the treadmill.

The frame 12 also includes a pair of armrests 25 approximately parallel to one another and extending outwardly from the frame on opposing sides of the treadmill 14, which form, as explained below, part of a sofa or loveseat when the handle portion 18 is in the inactive position. As shown in FIG. 2, a pair of seat cushions 28, each having a protrusion 30 extending from an underside 32 thereof and adapted to be received in the brackets 22 are releasably attachable to the handle portion 18 when in the inactive position. During operation, the seat cushions can be lifted and removed from the frame 12, thereby exposing the treadmill 14 such that the handle portion 18, as shown in FIG. 2 in the inactive position, can be moved to the upright and active position, thereby allowing the apparatus to function as exercise equipment. When not in use, the seat cushion 28 can be installed, thereby forming a sofa or loveseat capable of supporting at least one person in a seated position when the handle portion is in the inactive position.

Figure 3:
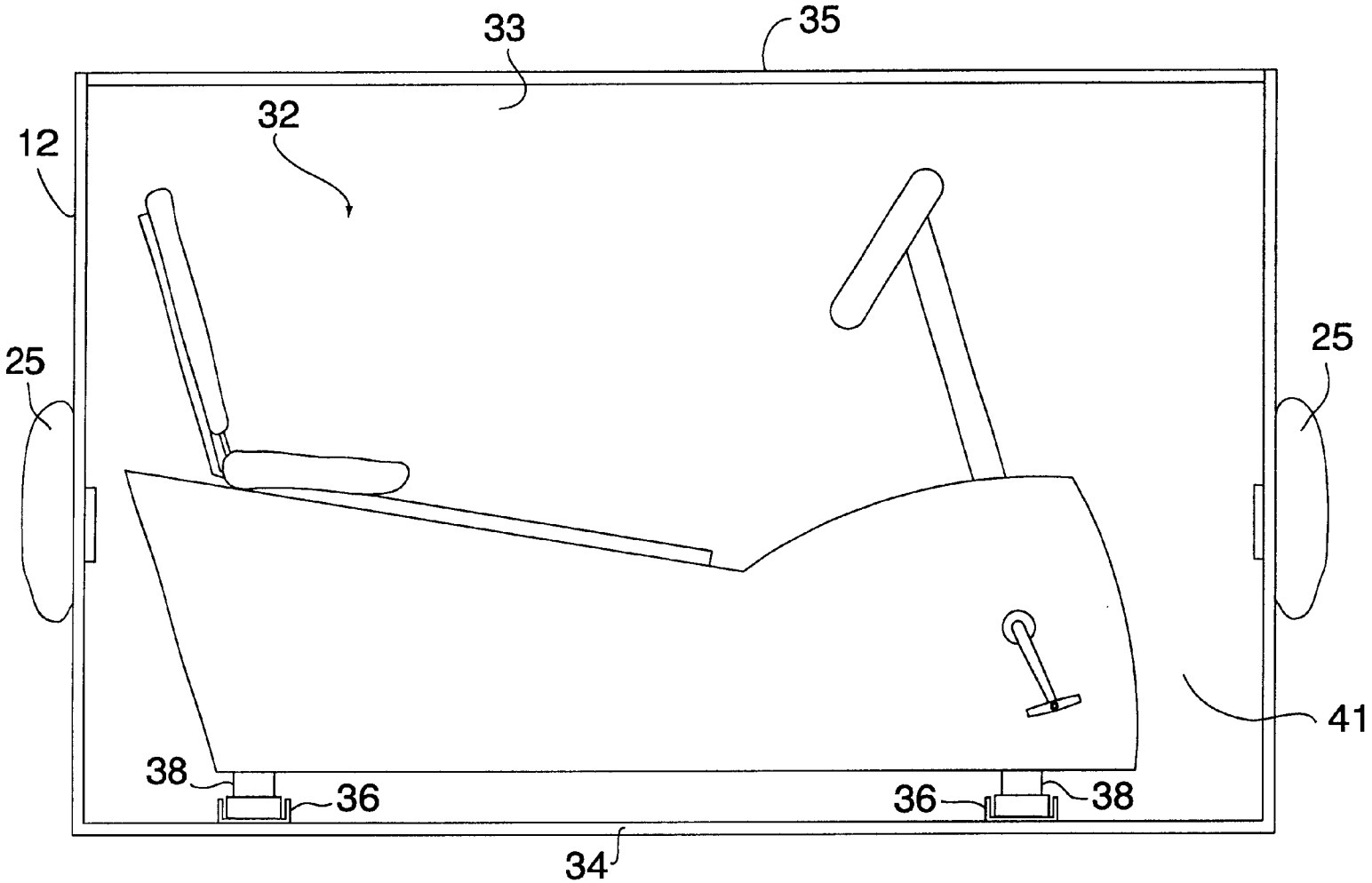
FIG. 3 is a partial front elevational view showing a sofa/loveseat in combination with a recumbent bike.

While a treadmill has been shown and described, the present invention is not limited in this regard and as shown in FIG. 3, the frame 12 can also be employed to support a recumbent bike generally designated by the reference numeral 32. The frame 12 includes a base section 34 upon which are mounted tracks 36 which mate with mounting members 38 extending from the bottom of the recumbent bike 32. The frame 12 includes an upstanding rear panel 33, a top panel 35 extending outwardly from, and approximately perpendicular to said rear panel and a front panel 39 coupled to said base section 34. The seat cushions 37 are removably positionable on the frame such that the frame and seat cushion substantially forms an article of furniture and defines an interior area 41 into which the bike is located when in the inactive position.

Figure 4:
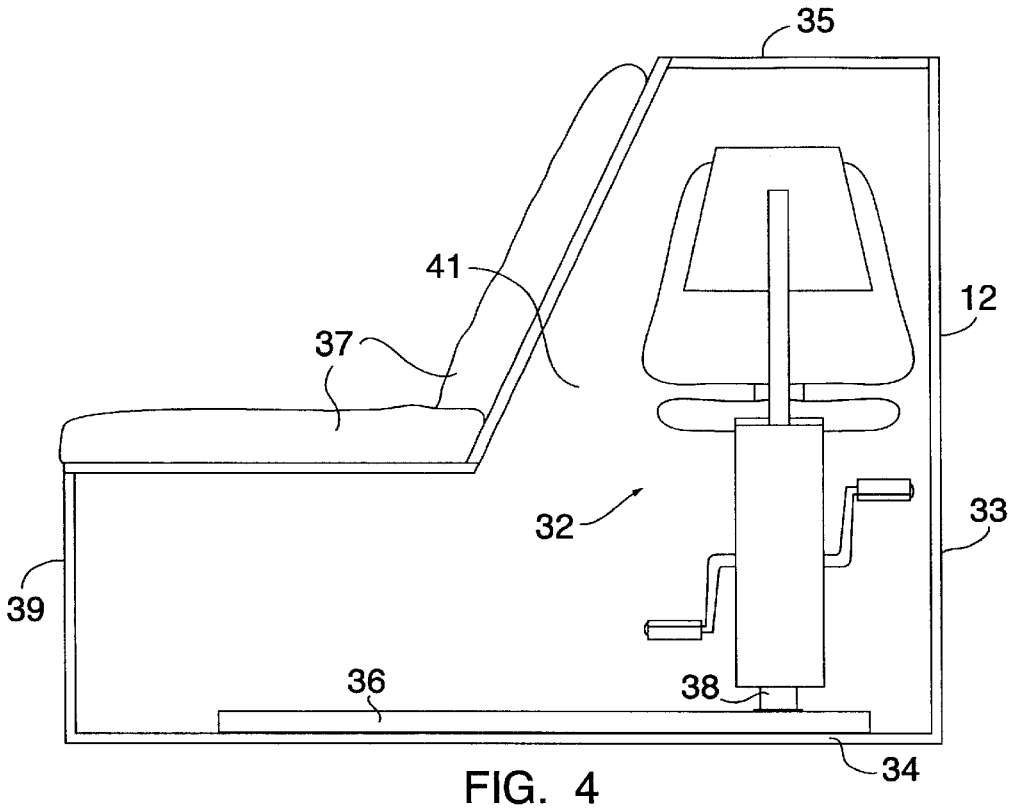
FIG. 4 is a cross sectional side elevational view of the apparatus of FIG. 3.

Referring to FIG. 4, during operation, the cushions 37 are removed from the frame 12 and the bike is slid along the tracks 36 to an active position wherein a user can operate the bike. While a recumbent bike has been shown and described, the present invention is not limited in this regard as an upright bike can be substituted without departing from the broader aspects of the present invention.

Figure 6:
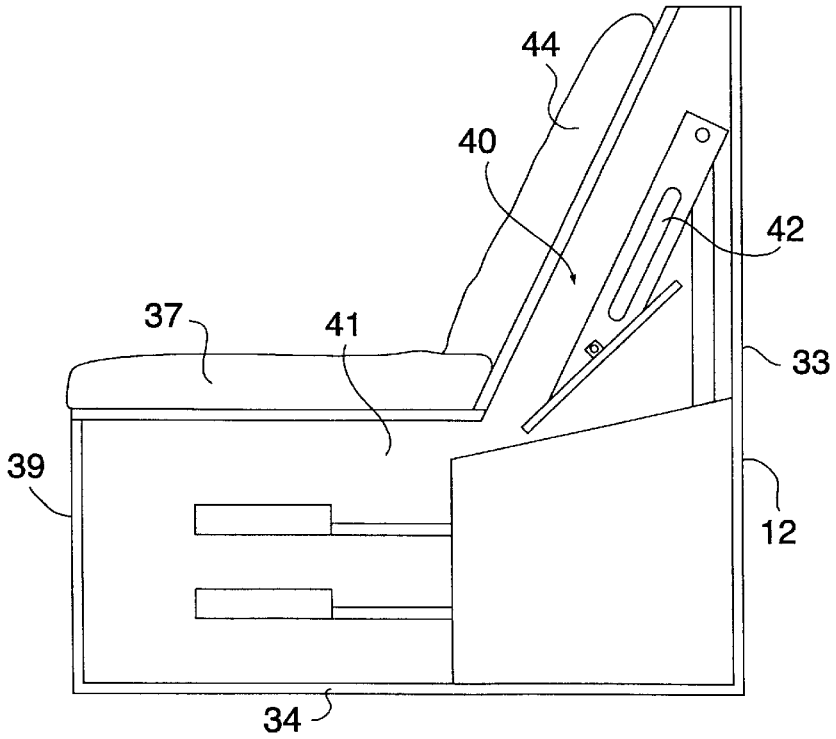
FIG. 6 is a cross sectional, side elevational view of the apparatus of FIG. 5 showing the stair stepper in the inactive position.
Figure 5:
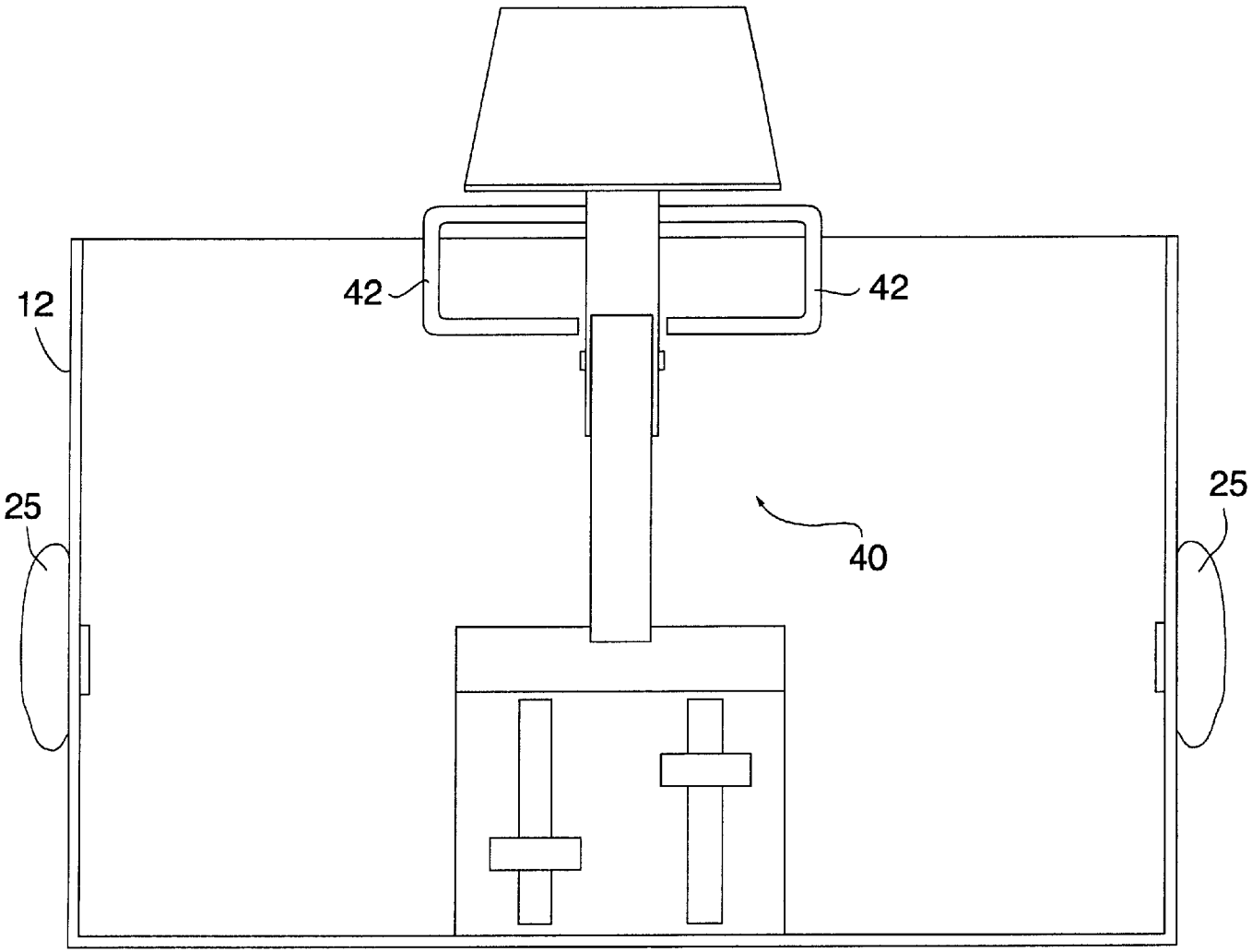
FIG. 5 is a front elevational view of a combination sofa/loveseat/stair stepper with the stair stepper shown in the active position.

Another embodiment of the present invention is shown in FIG. 5 and includes a stair stepper apparatus generally designated by the reference numeral 40 in combination with a sofa or loveseat. The stair stepper apparatus 40 includes a pair of opposed armrest portions 42 movable between an active position as shown in FIG. 5 and a folded, inactive position shown in FIG. 6. Referring to FIG. 6, when the stair stepper 40 is in the inactive position, a back cushion 44 and at least one seat cushion as described above can be coupled to the frame 12, thereby converting the frame into a sofa or loveseat adapted to support at least one person in a seated position. When in this position, the stair stepper is concealed within the frame 12. In order to operate the stair stepper, the cushions are removed and the armrest is moved from the inactive to the active position, thereby allowing a user to operate the exercise equipment.

While preferred embodiments have been shown and described, various modifications and substitutions may be made without departing from the spirit and scope of the present invention. Accordingly, it is to be understood that the present invention has been described by way of example and not by limitation.

What is claimed is:

1. A convertible cardiovascular exercise apparatus comprising:

a frame having an interior area adapted to support a cardiovascular exercise apparatus therein, said frame including a pair of arm rests coupled thereto on opposite sides thereof;

said cardiovascular exercise apparatus being movable between an inactive position wherein said cardiovascular exercise apparatus can be stored within said interior area, and an active position wherein said exercise apparatus can be put to use by a user; and means for concealing said cardiovascular exercise apparatus when in said inactive position, thereby converting said exercise apparatus to an article of furniture adapted to support at least one person in a seated position, and said arm rests being positioned for use by at least one person when seated.

2. A convertible cardiovascular exercise apparatus as defined by claim 1, wherein:

said cardiovascular exercise apparatus is a treadmill having a base section and a handle portion coupled to said base section and movable between said inactive position and said active position.

3. A convertible cardiovascular exercise apparatus as defined by claim 2 wherein:

said handle portion defines a support member;

said means for concealing said cardiovascular exercise apparatus includes at least one seat cushion releasably mountable to said support member when in said inactive position, thereby converting said exercise apparatus to an article of furniture adapted to support at least one person in a seated position.

4. A convertible cardiovascular exercise apparatus as defined by claim 3 wherein:

said support member includes at least one mounting bracket extending outwardly therefrom;

said seat cushion includes at least one protrusion extending outwardly from an underside thereof; and wherein said protrusion and said mounting bracket each define a peripheral shape complimentary to the other to allow said protrusion to engage said mounting bracket when said handle portion is in said inactive position thereby releasably securing said seat cushion to said handle portion and converting said exercise apparatus to an article of furniture adapted to support at least one person in a seated position.

5. A convertible cardiovascular exercise apparatus comprising:

a frame having an interior area adapted to support said cardiovascular exercise apparatus therein, said frame including a pair of arm rests coupled thereto on opposite sides thereof;

said cardiovascular exercise apparatus being a treadmill having a base section and a handle portion defining a support member coupled to said base section and being movable between an inactive position wherein said cardiovascular exercise apparatus can be stored within said interior area, and an active position wherein said exercise apparatus can be put to use by a user; and means for concealing said cardiovascular exercise apparatus when in said inactive position, wherein said means for concealing said cardiovascular exercise equipment includes at least one seat cushion releasably mountable to said support member when in said inactive position, thereby converting said exercise apparatus to an article of furniture adapted to support at least one person in a seated position thereby converting said exercise apparatus to an article of furniture adapted to support at least one person in a seated position.

6. A convertible cardiovascular exercise apparatus as defined by claim 5 wherein:

said support member includes at least one mounting bracket extending outwardly therefrom;

said seat cushion includes at least one protrusion extending outwardly from an underside thereof; and wherein said protrusion and said mounting bracket each define a peripheral shape complimentary to the other to allow said protrusion to engage said mounting bracket when said handle portion is in said inactive position thereby releasably securing said seat cushion to said handle portion and converting said exercise apparatus to an article of furniture adapted to support at least one person in a seated position.

* * * * *